US010036214B2

(12) United States Patent
Britton

(10) Patent No.: US 10,036,214 B2
(45) Date of Patent: Jul. 31, 2018

(54) CHRISTMAS TREE INSTALLATION USING COILED TUBING INJECTOR

(75) Inventor: Mark S. Britton, Carter, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 381 days.

(21) Appl. No.: 13/267,398

(22) Filed: Oct. 6, 2011

(65) Prior Publication Data

US 2012/0024538 A1 Feb. 2, 2012

Related U.S. Application Data

(63) Continuation of application No. 13/179,678, filed on Jul. 11, 2011, now abandoned.

(60) Provisional application No. 61/423,167, filed on Dec. 15, 2010.

(51) Int. Cl.

| | |
|---|---|
| ***E21B 19/02*** | (2006.01) |
| ***E21B 19/22*** | (2006.01) |
| ***E21B 33/02*** | (2006.01) |
| ***E21B 33/03*** | (2006.01) |
| ***E21B 33/04*** | (2006.01) |
| ***E21B 19/00*** | (2006.01) |

(52) U.S. Cl.

CPC ..... *E21B 19/00* (2013.01); *E21B 19/02* (2013.01); *E21B 19/22* (2013.01); *E21B 33/03* (2013.01); *E21B 33/04* (2013.01); *E21B 33/02* (2013.01)

(58) Field of Classification Search

CPC ..... E21B 19/02; E21B 19/22; E21B 33/02; E21B 33/03; E21B 33/04

USPC ... 166/377, 378, 379, 77.2, 85.4, 86.1, 86.2, 166/92.1

See application file for complete search history.

(56) References Cited

U.S. PATENT DOCUMENTS

| | | | | |
|---|---|---|---|---|
| 4,940,095 | A * | 7/1990 | Newman | 166/378 |
| 5,727,631 | A * | 3/1998 | Baker et al. | 166/379 |
| 5,975,203 | A * | 11/1999 | Payne | E21B 19/22 166/77.1 |
| 7,111,689 | B2 * | 9/2006 | Wise et al. | 166/384 |
| 7,681,632 | B2 * | 3/2010 | Wood | 166/77.1 |
| 2005/0247456 | A1 | 11/2005 | Wise et al. | |
| 2006/0124314 | A1 * | 6/2006 | Haheim et al. | 166/368 |

(Continued)

FOREIGN PATENT DOCUMENTS

EP 1724434 A1 11/2006

OTHER PUBLICATIONS

International Search Report and Written Opinion issued in corresponding international application No. PCT/US2011/063916 published on Jun. 21, 2012, as WO 2012/0825514.

*Primary Examiner* — George S Gray
(74) *Attorney, Agent, or Firm* — Mary M. Lee

(57) ABSTRACT

A method and system for installing a Christmas tree in place of a blowout preventer on a wellhead. The donut in the wellhead BOP is landed using a coiled tubing injector. Then the wellhead BOP is removed and the Christmas tree is installed using the same crane that supported the coiled tubing injector. This employs the coiled tubing rig already in use at the well site for a previous operation, such as plug drilling or perforating and fracturing. Notably, the system provides a second seal, such as a ceramic disk, below the donut while the Christmas tree is installed. The tool string used to install the donut includes a safety union so that the tool string can be disconnected after the donut is landed and locked into place.

7 Claims, 5 Drawing Sheets

(56) References Cited

U.S. PATENT DOCUMENTS

| | | | | |
|---|---|---|---|---|
| 2007/0131416 | A1* | 6/2007 | Odell, II | E21B 19/06 166/250.1 |
| 2009/0277647 | A1* | 11/2009 | Dallas | 166/380 |
| 2011/0169224 | A1* | 7/2011 | Nguyen | 277/314 |
| 2013/0014947 | A1* | 1/2013 | Wilkins et al. | 166/281 |
| 2013/0025848 | A1* | 1/2013 | Schepp et al. | 166/85.1 |
| 2014/0034392 | A1* | 2/2014 | Ganzinotti et al. | 175/57 |

* cited by examiner

CHRISTMAS TREE INSTALLATION USING COILED TUBING INJECTOR

CROSS-REFERENCE TO RELATED APPLICATION(S)

This application is a continuation of application Ser. No. 13/179,678, entitled "Christmas Tree Installation Using Coiled Tubing Injector," filed Jul. 11, 2011, which claims the benefit of the filing date of U.S. provisional application No. 61/423,167 filed Dec. 15, 2010, entitled "Christmas Tree Installation Using Coiled Tubing Injector." and the contents of the prior applications are incorporated herein by reference.

FIELD OF THE INVENTION

The present invention relates generally to oil field services and tools and, more particularly but without limitation, to methods and devices for replacing a well head blowout preventer with a Christmas tree.

DETAILED DESCRIPTION OF THE PREFERRED EMBODIMENT(S)

Coiled tubing is increasingly favored as a method for deploying tools and performing operations downhole. For example, coiled tubing is commonly used to drill out plugs and perform perforating and fracturing ("fracing") procedures. When these procedures are completed, the wellhead blowout preventer ("BOP") is removed and replaced with the Christmas tree, so that production can commence or resume.

The installation of the Christmas tree typically is done using a snubbing unit. This requires oilfield workers to be physically present immediately over the wellhead. Additionally, the snubbing procedure increases the pressure present in the well. Thus, a snubbing operation is inherently hazardous.

The present invention is directed to the use of the coiled tubing injector, instead of a snubbing unit, to remove the wellhead BOP and to install the Christmas tree. This reduces the high pressure hazards inherent in snubbing. Further, since the coiled tubing injector can be controlled remotely, there is no need for oilfield workers to remain standing over the wellhead while the installation is performed. These and other advantages will become apparent from the following description of the preferred embodiments of the invention.

The present invention comprises a system for replacing a wellhead blowout preventer ("BOP") with a Christmas tree.

Figure 1:
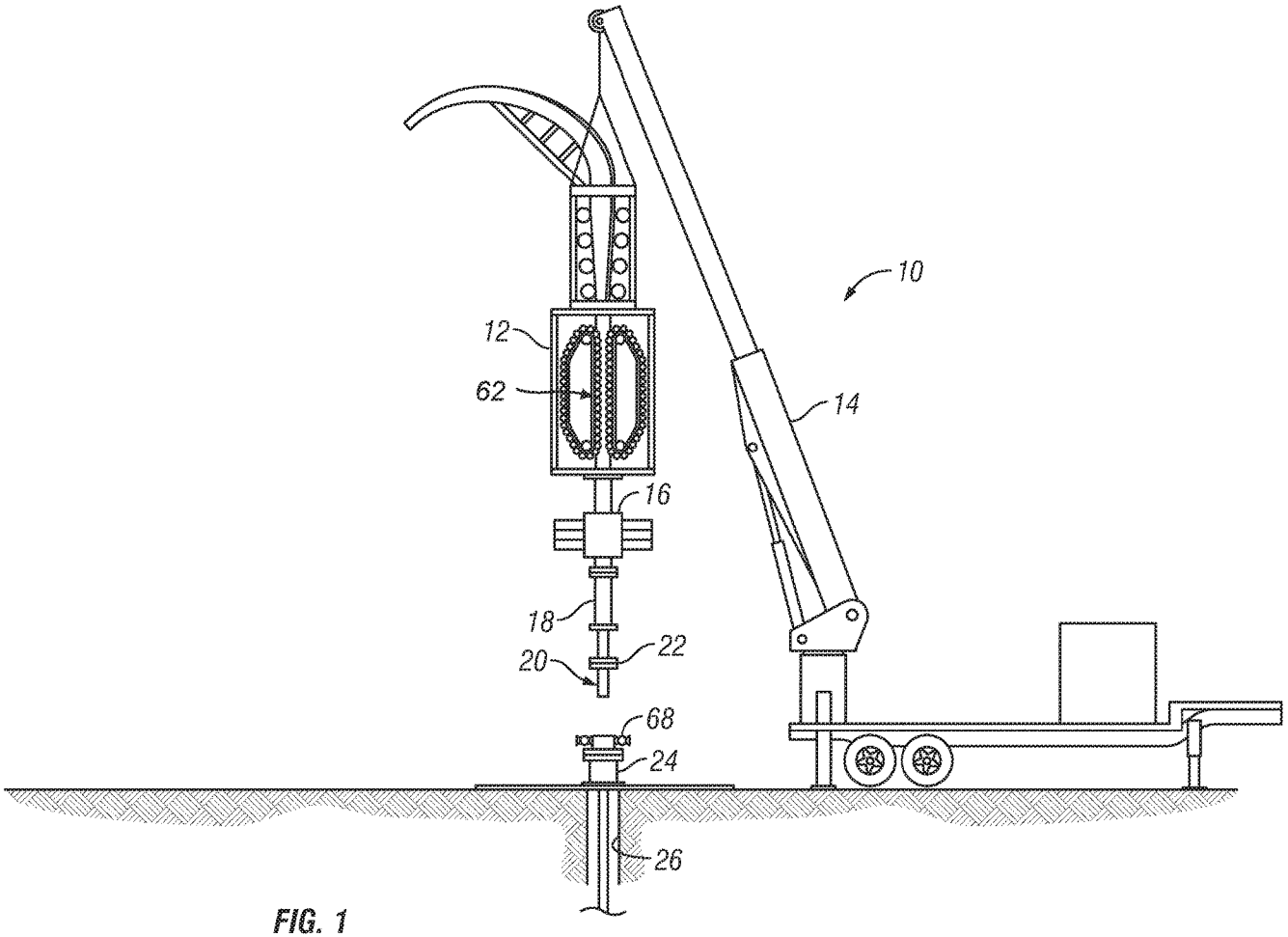
FIG. 1 is a schematic illustration of a coiled tubing rig at a well site. A tool string for installing the donut is suspended over the wellhead using the coiled tubing injector head.

An exemplary system, illustrated in FIG. 1 and designated generally therein by the reference numeral 10, comprises a coiled tubing ("CT") injector head 12 supported by a crane 14 or other lifting unit. As used herein, "lifting unit" refers to any device or machine used at the well site to lift and move well equipment, including but not limited to cranes, derricks, and the like.

In most instances, the inventive system 10 will include a blowout preventer 16 attached at the bottom of the injector head 12 in a usual manner. A spacer spool 18 may be attached to the bottom of the blowout preventer 16 for a reason that will become apparent.

The system 10 further comprises a tool string 20 for inserting the wellhead blowout prevent seal or "donut" 22 into the wellhead 24 accessing the well 26. The donut 22 is supported on the end of this tool string 20. In many cases, a well control assembly 28 is attached to the bottom of the donut 22, as described more fully below.

The dimensions, arrangements and components of the tool string 20 may vary. Since one of the advantages of the method and system of the present invention is the use of the crane and CT injector head already in place at the well site after performing another well operation, the dimensions of the tool string components should be sized for use in the CT injector head. For example, where the previous coiled tubing operation employs 2-inch coiled tubing, the components of the tool string 20 should have a 2-inch O.D.

Figure 2A:
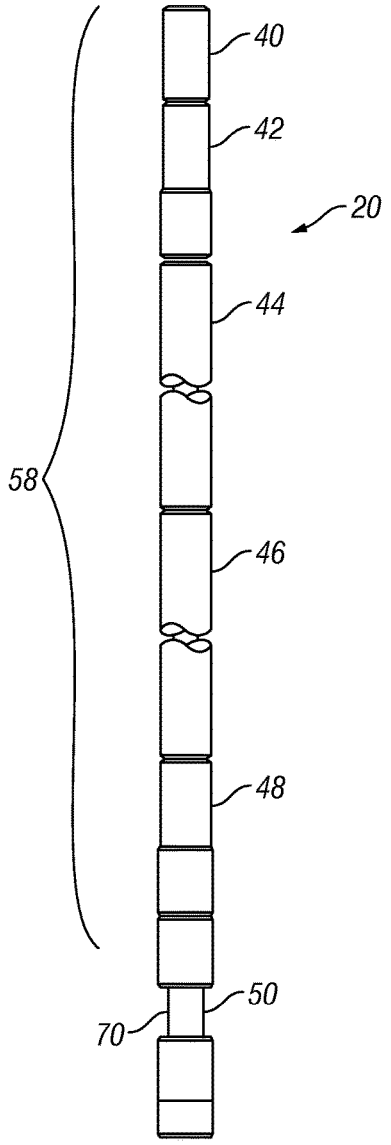
FIGS. 2A and 2B are sequential side elevational views of the tool string, donut and well control assembly.
Figure 2B:
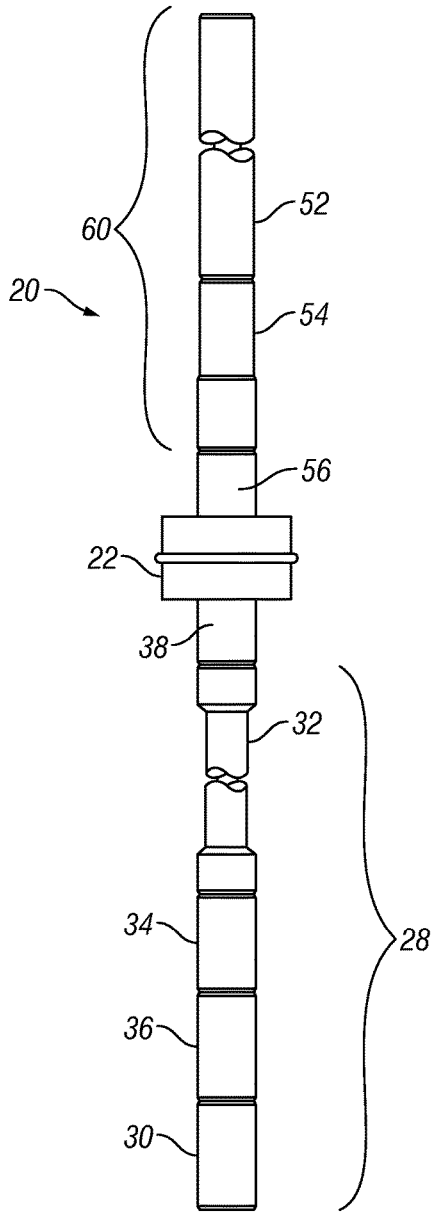

As shown in FIGS. 2A & 2B, the well control assembly 28, when used, may comprise a sealing tool, such as a ceramic disk or a burst disk sub 30, connected by a pup joint 32, a collar 34, and a nipple and profile 36 to the bottom end 38 of the donut 22. Where the well 26 (FIG. 1) is under relatively low pressure, the well control assembly 28 may be omitted.

The donut 22, also called a "slick neck" or "wrap around," is the seal, typically made of solid steel, that containing a removable back pressure valve. It is usually provided as part of the wellhead BOP.

Referring still to FIGS. 2A & 2B, the exemplary tool string 20 comprises a shutoff valve 40, a first crossover sub 42, a first long weight bar 44, a second long weight bar 46, a second crossover sub 48, a safety union 50, a short weight bar 52, and another crossover sub 54. The crossover sub 54 attaches to the upper end 56 of the donut 22. Again, the number and type of tools included in this assembly may vary. However, the tool string 20 preferably does have an upper segment disconnectable from a lower segment, once the donut is landed in the wellhead as described below. In the preferred embodiment, the segment above the safety union 50, or other disconnect, forms the upper segment 58 of the tool string 20, and the segment below the safety union forms the lower segment 60.

The method of the present invention commences with the rigging up of the tool string 20. The coiled tubing injector head 12 (with the coiled tubing removed) is positioned at a workable height. As shown in FIG. 1, the CT BOP 16 is supported in the grippers 62 (FIG. 1) of the injector head 12.

Next, the upper components of the installation tool string 20 shown in FIGS. 2A and 2B are assembled. This is carried out by supporting the uppermost tool(s) in the CT injector head 12 and then raising the tool string 20 with the injector head as tools are added.

By way of example, first the pressure shutoff valve 40 is installed on the upper end of the 2-inch OD long weight bar 44 of suitable length with the crossover sub 42 between. Then, with the CT BOP 16 in the open position, this partial tool string is inserted into the CT injector head 12. Next, the injector head 12 is operated to lift the lower end of the first weight bar 44 to a comfortable working level to support the partial tool string 20 for further assembly. The second 2-inch OD long weight bar 46 is attached to the end of the first weight bar 44.

Figure 3:
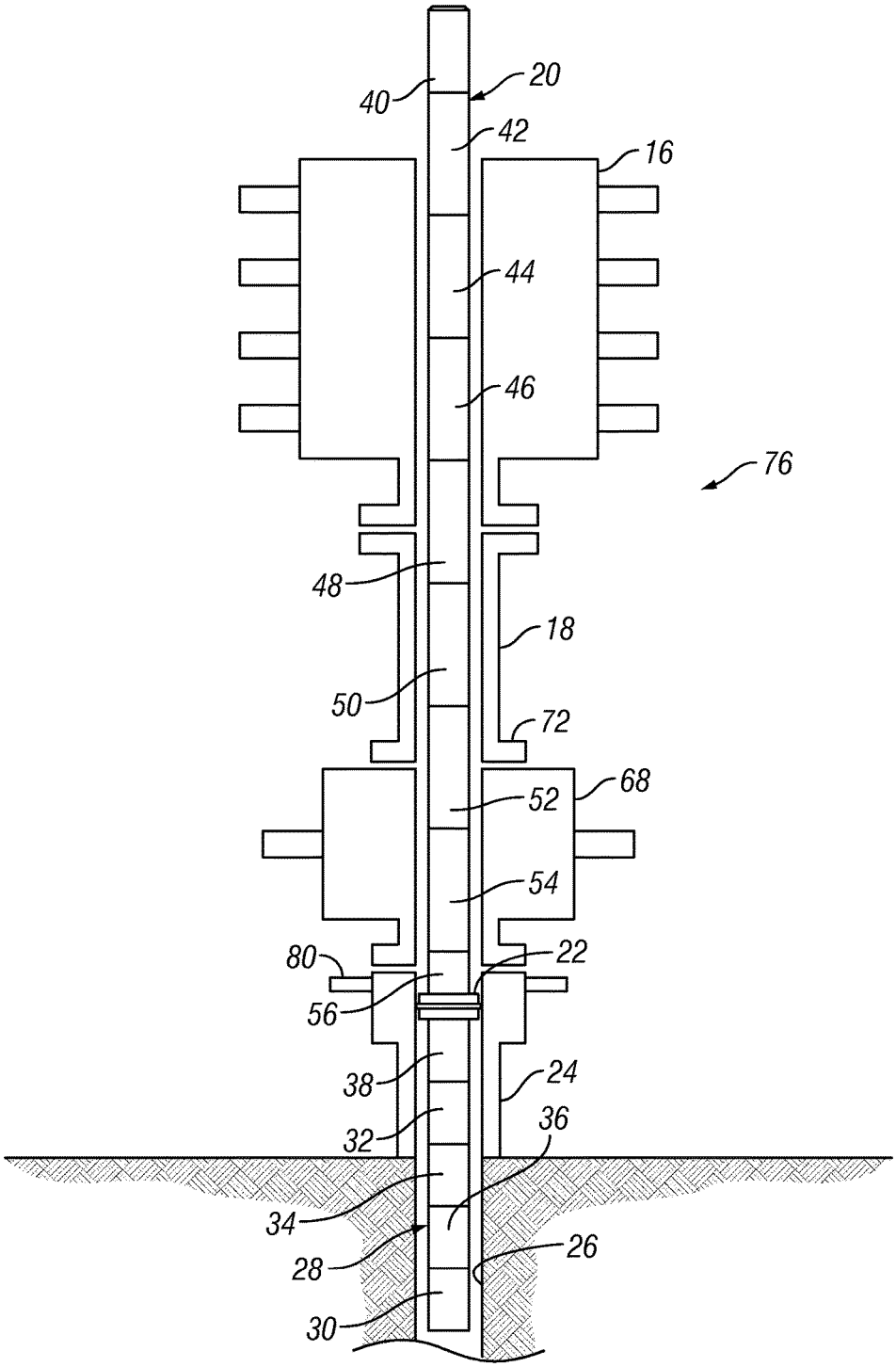
FIG. 3 shows an enlarged, schematic view of the tool string extending through the blowout preventer stack with the donut landed in the wellhead and locking bolts inserted.

Next, a 4-foot section of 7 1/16" spacer spool 18 is attached to the end of the CT BOP 16, as seen in FIGS. 1 and 3. The spool 18 will support the CT BOP 16 a distance above the wellhead BOP 68, as described hereafter.

Having attached the spool 18, the upper end of the partial tool string 20 is raised using the injector head 12. Next, the second crossover sub 48, safety union 50, the short weight bar 46, and the next crossover sub 48, if needed, are connected. Here, it should be noted that the safety union 50 comprises a swivel 70 for a purpose that will become apparent.

Now, the upper end 56 of the wellhead BOP's donut 22 (FIG. 2B) is connected to the end of the completed tool string 20. At this point, the depth of the donut's seat is marked on the tool string 20 for reference. Using the CT injector head 12, the tool string 20 is lowered beside the wellhead 24 until the lower end of the spacer spool 18 is positioned at the same height as the top of the wellhead BOP 68. Next, using the CT injector head control, the donut 22 is lowered down to the exact height where it will be seated in the wellhead 24, and this point is marked so that it can be seen easily.

Using the CT injector head 12, the tool string 20 is lifted again so that the donut 22 is raised above the wellhead BOP 68 again. Here, if desired, a well control assembly 26 may be attached to the bottom the donut 22. In the exemplary well control assembly 26 shown in FIGS. 2A and 2B, the pup joint 32, collar 34, nipple and profile 36, and burst disc sub 30 are connected on the lower end 38 of the donut 22, forming the well control assembly 26 (FIG. 2B). Now, the completed tool string 20 is raised in the CT injector head 12 until they "bump up."

With the tool string 20 completed, the BOP/Christmas tree switch may be made. As shown in FIG. 3, the injector head 12 is lowered over the wellhead 24 until the bolt flanges 72 on the spacer spool 18 and the wellhead BOP 68 are aligned. Thus, at this point, the wellhead 24, the wellhead BOP 68, the spacer spool 18, the CT BOP 16, and the CT injector head 12 all are bolted together in axial alignment forming a BOP stack 76. The BOP stack 76 allows the well pressure to be controlled while the donut 22 is installed. (In the illustration of FIG. 3 there are slight spaces between the abutting surfaces between the components of the BOP stack 76 and the connecting bolts are omitted. This is simply to clarify the illustration. In actuality, these connections are fluid-tight.)

After the spool 18 and CT BOP 16 are connected, the pressure above and below the wellhead BOP 68 inside the BOP stack 76 is equalized. The equalization lines (not shown) are connected and the lubricator (section of the coiled tubing unit) is pressure tested with the wellhead BOP 68 and the CT BOP 16 both in the closed position.

When the pressure above and below the wellhead BOP 68 is equalized, the wellhead BOP may be moved to the open position. Then, with the CT BOP 16 still closed, the tool string 20 is lowered using the injector head 12 until the donut 22 is "landed" or seated properly in the wellhead 24, as depicted in FIG. 3. This position is verified by referring to the marking made previously on the tool string 20. Once the position is verified, the donut 22 is locked into place by locking bolts 80 in the usual manner.

Once the donut 22 is secured, sealing off the well pressure, the pressure in the tool string 20 above the donut 22 is bled off by opening the valve in the CT BOP 16. Once the pressure is zero, the spacer spool 18 is unflanged from the wellhead BOP 68. The gripper chain pressure in the injector head 12 is released to loosen the grip on the tool string 20, and then the injector head 12 is lifted until the safety union 50 is visible.

The chain pressure is applied again to hold the upper end of the tool string 20 stationary against rotation, and the nut on the safety union 50 is spun to disconnect the upper section of tools by lifting the injector head 12. After swinging the disconnected upper segment 58 of the tool string 20 to the side of the wellhead 24, the upper segment can be disassembled and the injector head 12 removed from the crane 14 (FIG. 1).

Figure 4:
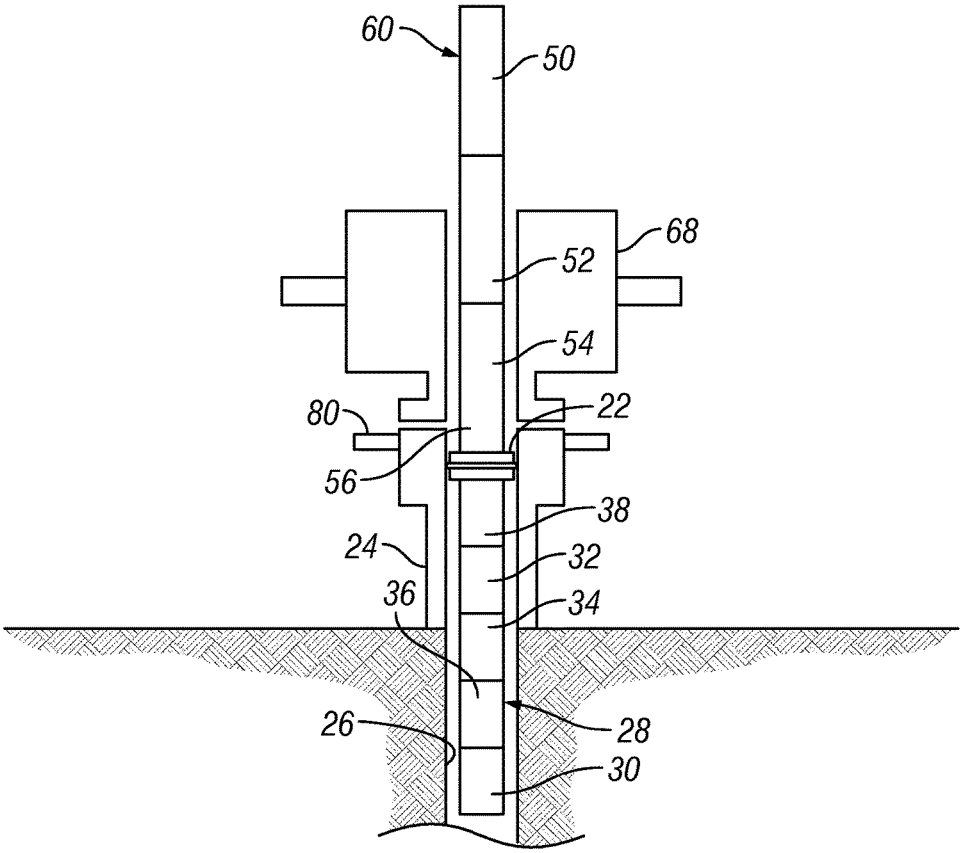
FIG. 4 shows the wellhead and wellhead blowout preventer with the upper segment of the tool string removed leaving the well control assembly (including a burst disk sub) and donut in place.

Having installed and secured the donut 22 in the wellhead 24, the wellhead BOP 68 can be removed also using the crane 14 or other lift mechanism that previously supported the CT injector head 12. The lower segment 60 of the tool string 20 may then be removed from the upper end 56 of the donut 22. It should be noted that there still are two pressure barriers closing off the well 36—the back pressure valve (not shown) in the donut 22 and the burst disc sub 30 in the well control assembly 28 beneath the donut, as seen in FIG. 4.

Figure 5:
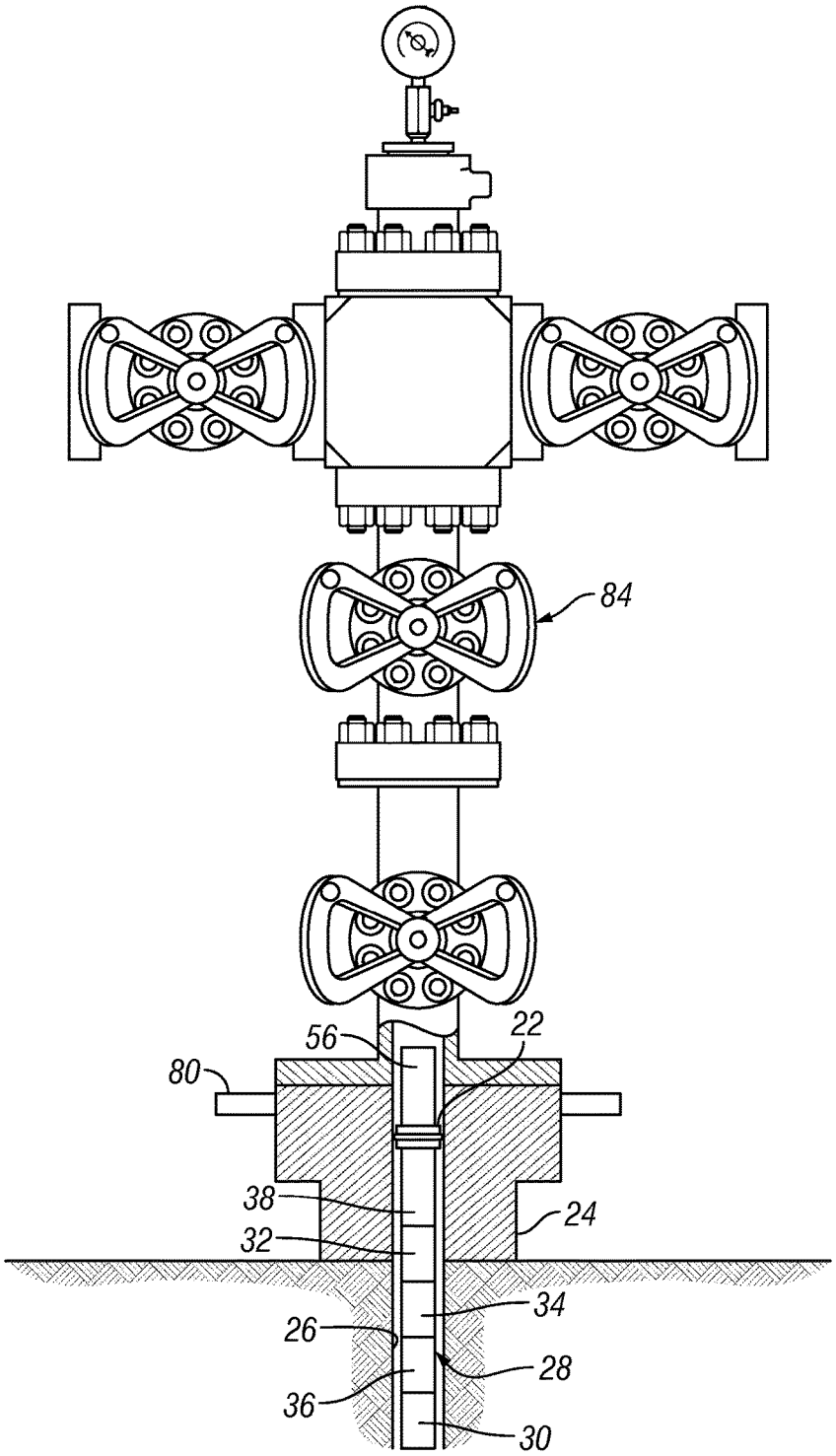
FIG. 5 shows the Christmas tree installed in place of the wellhead blowout preventer.

Still using the same crane 14, the Christmas tree 84 is lifted and positioned on the wellhead 24, as shown in FIG. 5. After bolting the Christmas tree 84 in place, the pressure is tested and equalized across the donut 22. Now that the Christmas tree 84 is installed on the wellhead 24, the back pressure valve may be removed from the donut 22 in the usual manner, typically by the company that provided the Christmas tree. Next, pressurized fluid is forced into the wellhead 24 to break the ceramic disk in the burst disk sub 30. Now, the well is ready to produce.

It will be appreciated that the present invention provides a method and system for removing the wellhead BOP and installing the Christmas tree that is both convenient and relatively inexpensive, as it employs the crane and injector head assembly already in place at the well site for deploying coiled tubing. Moreover, the remote operation of the CT injector head eliminates the need for workers to be standing immediately over the well as pressurized operations are conducted.

As used herein, phrases such as forwards, backwards, above, below, higher, lower, uphole and downhole are relative to the direction of advancement of the tool string in the well.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A method for replacing a wellhead blowout preventer on a wellhead with a Christmas tree, the method comprising:

supporting a coiled tubing injector head using a lifting unit, wherein the coiled tubing injector head comprises grippers;

supporting a tool string in the grippers of the coiled tubing injector head, wherein the tool string comprises a donut and is unconnected to a reel of coiled tubing;

installing the donut in the wellhead by inserting the tool string through the wellhead blowout preventer by operating the grippers of the injector head and lifting unit;

removing the wellhead blowout preventer using the lifting unit; and positioning the Christmas tree on the wellhead using the lifting unit;

wherein the coiled tubing injector head is equipped with a coiled tubing blowout preventer and wherein installing the donut comprises:

assembling the tool string using the grippers of the injector head to lift the tool string as tools are added;

attaching a spacer spool beneath the coiled tubing blowout preventer on the injector head;

attaching the donut to the downhole end of the tool string;

lowering the injector head using the lifting unit until the spacer spool abuts the wellhead blowout preventer;

connecting the spacer spool to the wellhead blowout preventer to make a pressurizable blowout preventer stack on the wellheads;

equalizing the pressure in the blowout preventer stack above and below the wellhead blowout preventer;

opening the wellhead blowout preventer;

advancing the tool string using the grippers of the injector head until the donut is properly placed; and locking the donut in place.

2. The method of claim 1 wherein the tool string comprises an upper segment and a lower segment, the lower segment disconnectable from the upper segment, and wherein removing the wellhead blowout preventer comprises:

depressurizing the blowout preventer stack above the wellhead blowout preventer;

disconnecting the spacer spool from the wellhead blowout preventer;

disconnecting the upper segment of the tool string from the lower segment;

removing the coiled tubing injector head, the coiled tubing blowout preventer, and the spacer spool from the crane;

disconnecting the wellhead blowout preventer; and removing the wellhead blowout preventer from the wellhead using the crane.

3. The method of claim 2 wherein the tool string comprises a safety union between the upper and lower segments and wherein disconnecting the lower segment of the tool string from the upper segment comprises:

releasing the grip of the grippers of the injector head on the upper segment of the tool string;

raising the injector head using the crane until the safety union in the tool string is accessible between the spacer spool and the wellhead blowout preventer;

gripping the upper segment of the tool string with the grippers of the injector head; and disconnecting the upper segment of the tool string from the lower segment of the tool string at the safety union.

4. The method of claim 3 wherein disconnecting the lower segment of the tool string from the upper segment comprises:

before removing the wellhead blowout preventer, removing the lower segment of the tool string from the donut in the wellhead.

5. The method of claim 3 wherein positioning the Christmas tree further comprises:

connecting the Christmas tree to the wellhead; and equalizing pressure across the donut.

6. The method of claim 5 further comprising:

after attaching the donut to the tool string, attaching a well control assembly to the donut, the well control assembly including a burst disk sub; and after positioning the Christmas tree on the wellhead, bursting the burst disk sub.

7. The method of claim 6 further comprising:

after attaching the donut to the tool string, attaching a well control assembly to the donut, the well control assembly including a burst disk sub.

* * * * *